US005357079A

United States Patent [19]

Henry et al.

[11] Patent Number: 5,357,079

[45] Date of Patent: Oct. 18, 1994

[54] COOKTOP WITH UPWARDLY ANGLED CONTROL SURFACE

[75] Inventors: Karlheinz Henry, Trostberg; Georg Brandl, Palling, both of Fed. Rep. of Germany

[73] Assignee: Bosch-Siemens Hausgeräte GmbH, Munich, Fed. Rep. of Germany

[21] Appl. No.: 64,846

[22] Filed: May 20, 1993

[30] Foreign Application Priority Data

May 20, 1992 [DE] Fed. Rep. of Germany ..... 4216677

[51] Int. Cl.[5] ..... F24C 15/10; F24C 7/08; F24C 15/00

[52] U.S. Cl. ..... 219/453; 219/464; 219/458; 126/211

[58] Field of Search ..... 219/443–468; 126/214 A, 214 R, 214 D, 211; 116/315, 316, 318, 279, 298, 305

[56] References Cited

FOREIGN PATENT DOCUMENTS 14158 2/1989 Fed. Rep. of Germany .
06359 10/1991 Fed. Rep. of Germany .
2462663 3/1981 France .
2100853 1/1983 United Kingdom ..... 219/458
2125537 3/1984 United Kingdom ..... 219/464
2212260 7/1989 United Kingdom .

*Primary Examiner*—Bruce A. Reynolds
*Assistant Examiner*—John A. Jeffery
*Attorney, Agent, or Firm*—Herbert L. Lerner; Laurence A. Greenberg

[57] ABSTRACT

A cooktop includes a horizontal cooking surface having boundary sides and preferably a plurality of cooking locations. A narrow control surface is disposed at an angle relative to the cooking surface along at least one of the boundary sides of the cooking surface. The control surface slopes upwardly, is oriented toward the cooking surface and directly adjoins the cooking surface in a flush manner, at least substantially seamlessly. Operating and/or indicator devices and at least one heating element are provided for the at least one cooking location. A cooktop frame supports the cooking and control surfaces, the at least one heating element, and the operating and/or indicator devices.

10 Claims, 1 Drawing Sheet

COOKTOP WITH UPWARDLY ANGLED CONTROL SURFACE

BACKGROUND OF THE INVENTION

1. Field of the invention

The invention relates to a cooktop or rangetop, including a horizontal cooking surface preferably having a plurality of burners or cooking locations, a narrow control surface disposed at an angle relative to the cooking surface along at least one boundary side of the cooking surface, operating and/or indicator devices for the burners or cooking locations, and a cooktop frame supporting the surfaces as well as heating elements and the operating and/or indicator devices and the like.

2. Description of the Related Arts

In household cooktops, it is known (from German Petty Patent DE-GM 88 14 158) for the back of a closed frame which carries a glass ceramic plate that has burners or cooking locations and surrounds the glass ceramic plate, to be provided with a podium-like raised portion, with a control panel that slopes upward relative to the cooking surface, with the control panel being a component of the frame and carrying the indicators and operating elements for the burners or cooking locations. A frame-like strip for joining a glass ceramic cooking area to a control part is also known (from Petty Patent DE-GM 91 06 359), in which the framelike strip includes a profiled part encompassing end surfaces of the cooking area and of the operating part. The profiled part, protruding above the surface of the cooking area and the operating part, forms a functional and visually perceptible boundary for the cooking area on one hand, and for the operating part on the other hand, on the order of a frame of the first type discussed above. It is accordingly an object of the invention to provide a cooktop, which improves upon the hereinafore-mentioned disadvantages of the heretofore-known devices of this general type in terms of its use and manufacture and last but not least in terms of its appearance as well.

SUMMARY OF THE INVENTION

With the foregoing and other objects in view there is provided, in accordance with the invention, a cooktop, comprising a horizontal cooking surface having boundary sides and preferably a plurality of cooking locations; a narrow control surface disposed at an angle relative to the cooking surface along at least one of the boundary sides of the cooking surface, the control surface sloping upwardly, being oriented toward the cooking surface and directly adjoining the cooking surface in a flush manner, at least substantially seamlessly; operating and/or indicator devices and at least one heating element for the cooking locations; and a cooktop frame supporting the cooking and control surfaces, the at least one heating element, the operating and/or indicator devices and the like.

In accordance with another feature of the invention, the cooking surface and the control surface have the same surface structure.

The configuration according to the invention avoids a functional and visually perceptible boundary of the cooking surface and the control surface. This means that raised, striplike boundary elements between the cooking surface and the control surface, which form ridges or gaps where they meet and which are known from experience to be hard to clean, are dispensed with. Connecting elements between these surfaces, for instance in the form of T-shaped connecting strips, which must be sealed off from the aforementioned surfaces to prevent the penetration of liquids, and which accordingly require considerable effort to manufacture, are also dispensed with. Last but not least, the structure according to the invention not only improves utility, particularly in terms of easier cleaning of the entire cooktop surface, as well as advantages from a manufacturing standpoint, but also improves the appearance of the cooktop, especially because the cooking surface is visually broadened.

In accordance with a further feature of the invention, glass ceramic plates are used for the cooking surface and the control surface. This structure is particularly advantageous.

In accordance with an added feature of the invention, the cooking surface and the control surface define a boundary region therebetween, and the cooking surface and the control surface are formed of a one-piece glass ceramic plate being bent in the boundary region. If the surfaces are integral, even when the two surfaces are joined in the manner of a film hinge, advantages in terms of manufacture are attained both upon mounting the unit with these surfaces in the cooktop frame and in sealing off or adhesively bonding the surfaces and the cooktop frame.

In accordance with an additional feature of the invention, the cooking surface and the control surface are formed of separate glass ceramic plates having adjoining edges being joined together, preferably with permanently-elastic adhesive material.

In accordance with yet another feature of the invention, the two glass ceramic plates are pivotable toward one another for assembly by means of elasticity of the adhesive material.

In accordance with yet a further feature of the invention, the cooking surface and the control surface have free boundary edges being encompassed by the cooktop frame.

In accordance with a concomitant feature of the invention, the cooking surface has a lateral boundary on which the control surface is disposed.

Other features which are considered as characteristic for the invention are set forth in the appended claims.

Although the invention is illustrated and described herein as embodied in a cooktop, it is nevertheless not intended to be limited to the details shown, since various modifications and structural changes may be made therein without departing from the spirit of the invention and within the scope and cook of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
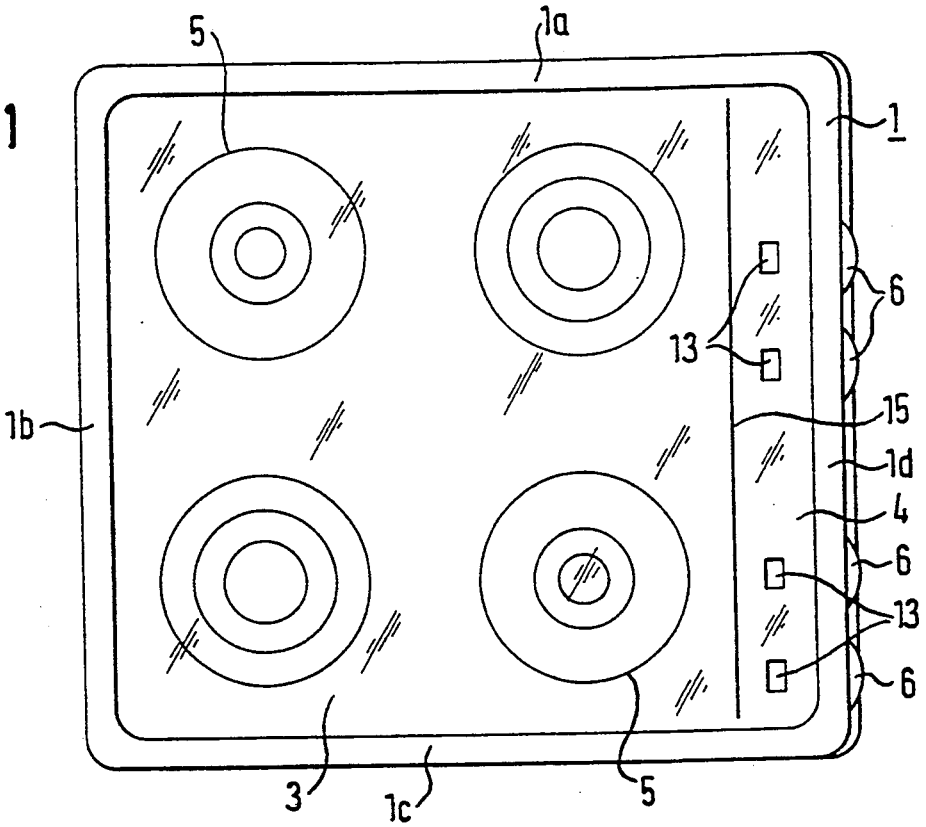
FIG. 1 is a diagrammatic, top-plan view of a cooktop.

Referring now in detail to the figures of the drawing as a whole, there is seen a cooktop or rangetop which is formed of a cooktop frame 1 surrounding the entire cooktop, with frame legs 1*a*, 1*b*, 1*c* and 1*d* abutting one another at right angles and boundary legs, such as 1*f* and 1*g*, protruding substantially vertically downward, a substructure 1*h* that is not described in further detail but is used for receiving and retaining operating and indicator devices 2 and non-illustrated heating bodies. Disposed inside the frame legs 1*a*–1*d* are a cooking surface 3 formed of glass ceramic material, and laterally beside it a control surface 4, below which the aforementioned operating and indicator devices 2 are located. The likewise aforementioned heating bodies are located underneath the cooking surface 3, specifically in the region of burner or cooking location markings, such as that shown at reference numeral 5. A total of four burner or cooking location markings are shown in the exemplary embodiment. The operating and indicator devices substantially include knurled disks 6 protruding slightly outwardly to the side beyond the boundary leg 1*f*, for adjusting the heating output for the burners or cooking locations 5. These disks may be connected to encoding switches 7 and corresponding electric switch devices connected to the heating bodies. One indicator device 8, for example in the form of a seven-segment display, is likewise associated with each knurled disk 6.

Figure 2:
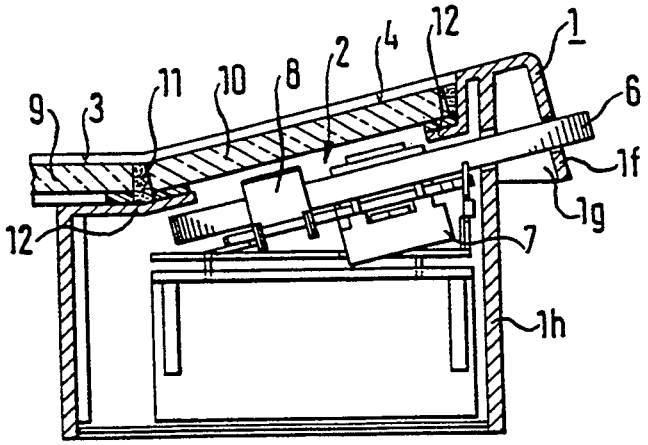
FIGS. 2 and 3 are fragmentary, longitudinal-sectional views of the cooktop, with two different embodiments of a unit including a cooking surface and a control surface.
Figure 3:
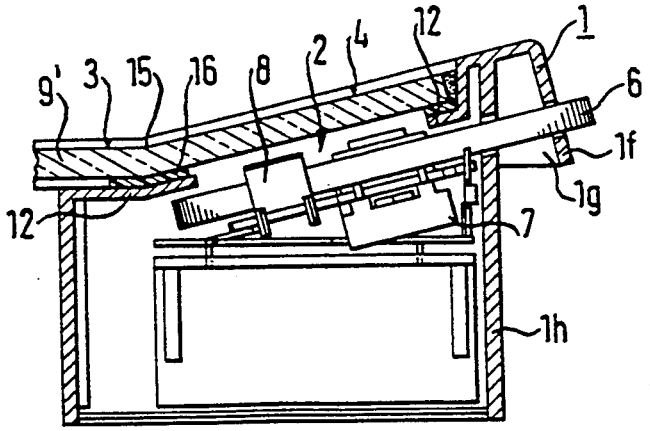

In both exemplary embodiments of FIGS. 2 and 3, both the cooking surface 3 and the control surface 4 are formed of glass ceramic material. In FIG. 2, the cooking surface 3 is formed of a substantially square glass ceramic plate 9, while the control surface 4 is formed by an elongated, narrow glass ceramic plate 10 having the same surface structure and properties. Where they meet, the two plates 9 and 10 are immediately adjacent one another and are joined flexibly to one another by means of a permanently-elastic adhesive material 11, such as silicon adhesive, in such a way that the two plates 9 and 10 abut one another virtually seamlessly. The two glass ceramic plates 9 and 10 thus form a structural unit, which is manufactured as a flat package and is kept in inventory and which, when Joined to the cooktop frame 1, is brought to the swiveled position of FIG. 2 in the manner of a film hinge. In order to retain this composite unit, corresponding supports 12 are provided on the cooktop frame. The composite unit is placed on the supports 12 and sealed off at its periphery from the cooktop frame 1 with a suitable sealing material. At the level of the display devices 8, the glass ceramic plate 10 forming the control surface 4 has corresponding transparent regions 13, through which the seven-segment display can be seen.

In the exemplary embodiment of FIG. 3, the cooking surface 3 and the control surface 4 are formed of a one-piece glass ceramic plate 9', which is bent at an angle at a point or bending region marked with reference numeral 15. This bending region 15 is located relatively far away from the burners or cooking locations, so that any alteration in the material structure that might occur in the bending process cannot have a harmful effect from a thermal standpoint. In the exemplary embodiment, the bending region or point 15 of the glass ceramic plate 9' rests on a sealing composition 16 disposed on the support 12. In both exemplary embodiments, the control surface 4 is disposed laterally beside the cooking surface 3, in the preferred manner. However, a possibility also exists within the scope of the present invention of providing this control surface at some other boundary edge of the cooking surface.

We claim:

1. A cooktop, comprising:

a horizontal cooking surface having boundary sides and at least one cooking location;

a narrow control surface disposed at an angle relative to said cooking surface along at least one of said boundary sides of said cooking surface, said control surface sloping upwardly, being oriented toward said cooking surface and directly adjoining said cooking surface in a flush manner, at least substantially seamlessly;

at least one of operating and indicator devices and at least one heating element for said at least one cooking location; and a cooktop frame supporting said cooking and control surfaces, said at least one heating element, and said at least one of operating and indicator devices.

2. The cooktop according to claim 1, wherein said cooking surface has a plurality of cooking locations.

3. The cooktop according to claim 1, wherein said cooking surface and said control surface have the same surface structure.

4. The cooktop according to claim 3, wherein said cooking surface and said control surface are formed of glass ceramic material.

5. The cooktop according to claim 4, wherein said cooking surface and said control surface define a boundary region therebetween, and said cooking surface and said control surface are formed of a one-piece glass ceramic plate being bent in said boundary region.

6. The cooktop according to claim 4, wherein said cooking surface and said control surface are formed of separate glass ceramic plates having adjoining edges being joined together.

7. The cooktop according to claim 6, wherein said separate glass ceramic plates are joined together by permanently-elastic adhesive material.

8. The cooktop according to claim 7, wherein said two glass ceramic plates are pivotable toward one another for assembly by means of elasticity of said adhesive material.

9. The cooktop according to claim 1, wherein said cooking surface and said control surface have free boundary edges being encompassed by said cooktop frame.

10. The cooktop according to claim 1, wherein said cooking surface has a lateral boundary on which said control surface is disposed.

* * * * *